United States Patent [19]

Nemit

[11] 4,263,568

[45] Apr. 21, 1981

[54] LARGE SCALE LOW-LOSS COMBINER AND DIVIDER

[75] Inventor: Jeffrey T. Nemit, Canoga Park, Calif.

[73] Assignee: International Telephone and Telegraph Corporation, New York, N.Y.

[21] Appl. No.: 19,481

[22] Filed: Mar. 12, 1979

[51] Int. Cl.[3] ..... H01P 5/12

[52] U.S. Cl. ..... 333/127; 333/128; 333/26; 333/251

[58] Field of Search ..... 333/26, 125, 136, 137, 333/251, 127, 128; 330/286, 287, 295; 331/56, 107 P

[56] References Cited

U.S. PATENT DOCUMENTS

| | | | |
|---|---|---|---|
| 3,582,813 | 6/1971 | Hines | 331/107 P X |
| 3,662,285 | 5/1972 | Rucker | 333/125 X |
| 3,728,648 | 4/1973 | Lerner | 333/21 R X |
| 3,942,130 | 3/1976 | Harp | 333/21 R X |
| 4,005,379 | 1/1977 | Lerner | 333/136 |

FOREIGN PATENT DOCUMENTS

| | | | |
|---|---|---|---|
| 1243741 | 7/1967 | Fed. Rep. of Germany | 333/137 |

*Primary Examiner*—Paul L. Gensler
*Attorney, Agent, or Firm*—William T. O'Neil

[57] ABSTRACT

A radio frequency power divider/combiner having a pair of conductive plates between which the dominant E-type mode is produced by symmetrical excitation at a central point preferably by means of a coaxial line having its outer conductor attached to the first of these plates, and its inner (center) conductor passing freely therethrough and attaching to the second of these parallel plates in an impedance matching flareout. A plurality of uniformly distributed collectors each in the form of a loop feeding the coaxial branch port provides for low loss. The entire assembly is in the form of a thick disc with radially extended branch ports about its perimeter and a common excitation feed extending normally from the surface of the first plate. Resistors are provided between adjacent portions of the end-on loops for the suppression of circumferential current components corresponding to undesired modes.

6 Claims, 5 Drawing Figures

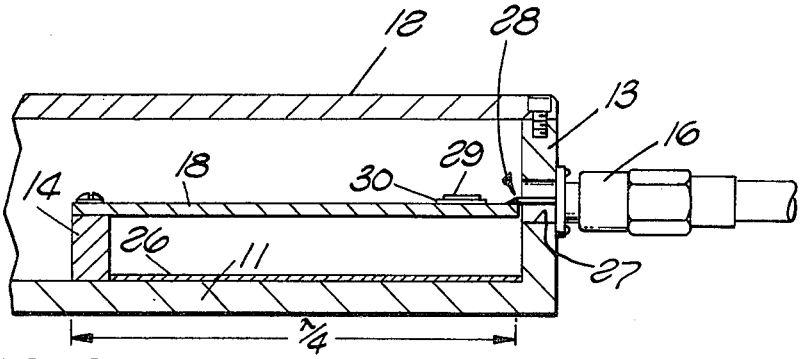
FIG. 2
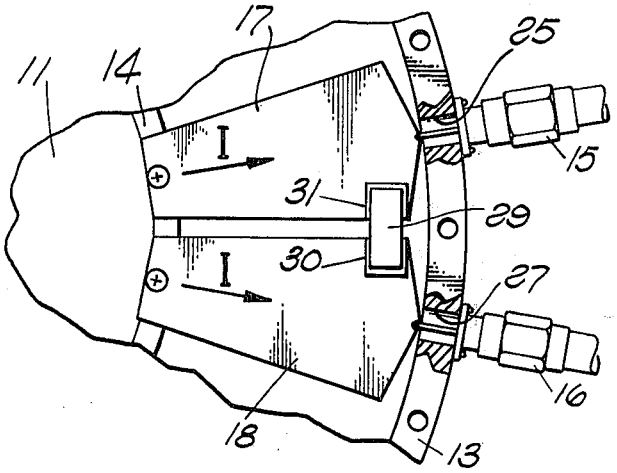
FIG. 3
FIG. 4
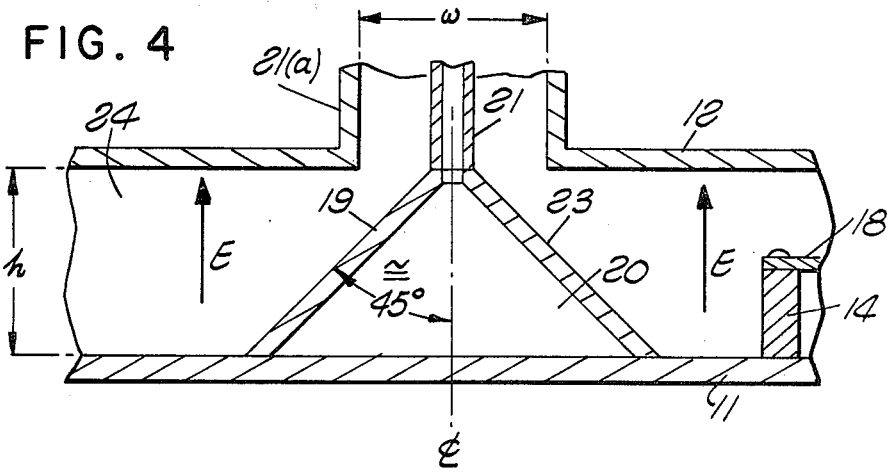

LARGE SCALE LOW-LOSS COMBINER AND DIVIDER

BACKGROUND OF THE INVENTION

1. Field of the Invention

This invention relates to radio frequency divider/-combiner apparatus generally and more particularly to such apparatus operative in the microwave region.

2. Description of the Prior Art

In modern radar systems, various requirements are extant for low loss radio frequency power division and-/or recombination. One such requirement arises in so-called unattended or minimally attended radar systems. In those systems, generation of the radio frequency power is effected by paralleling the outputs of a number of solid state RF generators. In this way, the failure of any one radio frequency module does not produce a total failure of the radio frequency power output stage, as would be the case where a single magnetron or other radio frequency generator were employed. Such a system is described in copending U.S. patent application Ser. No. 955,349, filed Oct. 27, 1978, and entitled "Automatic Failure-Resistant Radar Transmitter". That application is assigned to the Assignee of this application.

In the aforementioned U.S. patent application, Ser. No. 955,349, the prior art in respect to power divider/-combiner apparatus is reviewed in some detail. For example, the so-called Gysel and Wilkinson combiners are identified and the relative technical literature is likewise referenced.

Neither of those prior art divider/combiner structures is suitable for a relatively large number of divisions, i.e., where the correspondingly large number of branching ports are desired. Moreover, those prior art devices usually rely on stripline design, and accordingly are not as adaptable to higher power levels as might be desired in some instances.

Of course, there are many other applications for divider/combiner apparatus, such as in connection with multielement antenna systems, for example. The manner in which the invention produces novel structure and results to provide a large number of branching ports in a low loss combiner/divider device will be understood as this description proceeds.

SUMMARY

Basically, the device of the invention employs a radial parallel plate waveguide with central point of excitation such that energy in a dominant E-type mode propagates outward therefrom. For the dominant mode the currents are purely in the radial direction with the electric field normal to the top and bottom metal plates of the parallel plate waveguide configuration. A plurality of collectors are uniformly placed on the circumference of the circular wave front and therefore there is a constant phase and amplitude relationship set up. That is, each of the collectors receives energy from the radial current intercepted, the phase and amplitude of this energy being the same for each of the collectors with respect to the central feed.

Each of the collectors is a loop including a wedge-shaped planar conductor over approximately a quarter wavelength in radial dimension and width sufficient to abut the circumferentially adjacent loops save for a relatively small separation gap. A conductive post extending from the inside surface of one of the parallel plate waveguide walls serves to position each of the aforementioned wedge-shaped loop legs in a plane between the two parallel plates forming the waveguide walls and provides a current path to the waveguide wall. Each of the branch ports, which are preferably coaxial, connects to the outward extremity of the loop leg thus suspended between the parallel waveguide plates. The return path is completed to the coaxial port outer conductor through the circumferential outer wall enclosing the circular waveguide configuration. Higher order modes as may be generated due to asymmetry and unequal branch port loading are suppressed by circumferentially placed resistors between adjacent loop legs for suppressing circumferential currents produced by these higher order undesired modes. These resistors may be pads of carbon resistance material in many applications or for higher power operation may be nichrome on beryllium oxide. The structure of the individual loops connected to the respective branch ports is such that each operates as a balun converting the basically balanced field situation between the parallel radial waveguide plates to the unbalanced branch port represented by a coaxial connector for example. This balun structure will be seen to operate as a four-to-one impedance transformer. The details of a typical embodiment according to the invention will be understood as this description proceeds.

BRIEF DESCRIPTION OF THE DRAWINGS

FIG. 2 is a section taken through FIG. 1A as indicated assuming that the cover and feed assembly of FIG. 1A is in place.

FIG. 3 is a detail showing two of the wedge-shaped coupling loop legs and associated apparatus according to FIG. 1A and FIG. 2.

FIG. 4 is a partial section through FIG. 1A showing the central feed and conical transition section therefor.

DETAILED DESCRIPTION

Figure 1A:
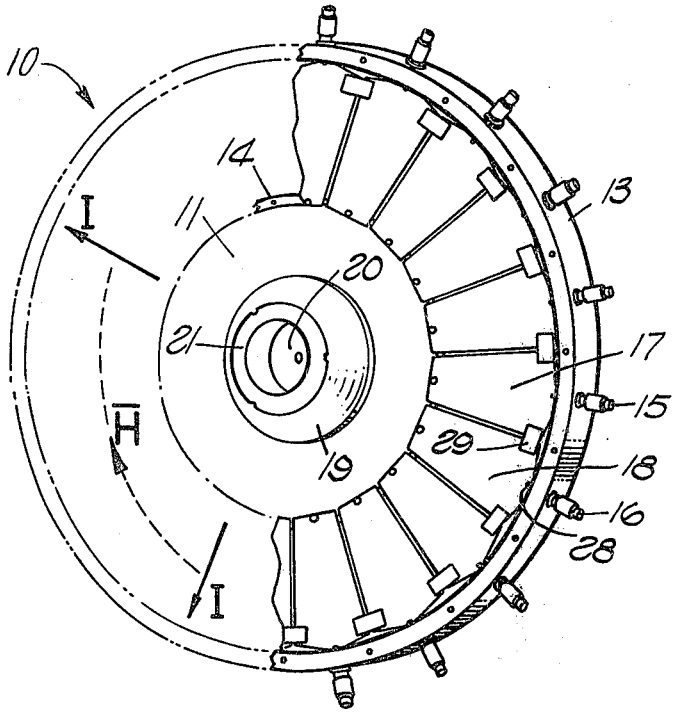
FIG. 1A is a pictorial internal view of the device according to the invention.
Figure 1B:
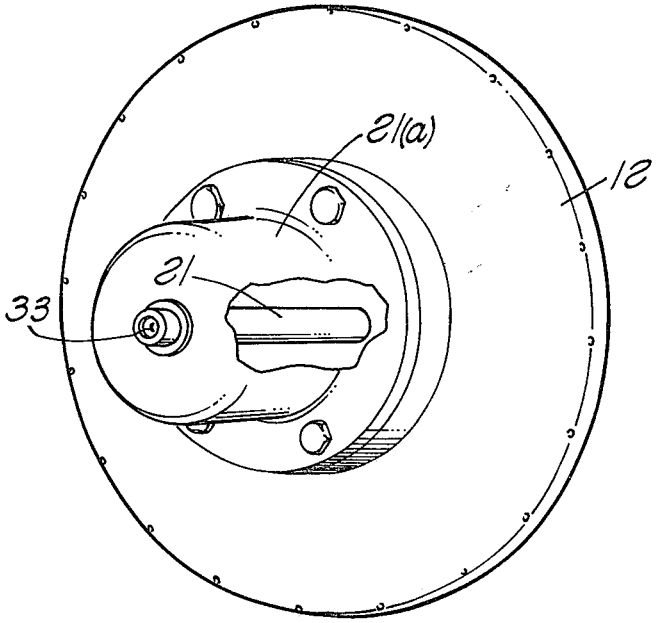
FIG. 1B is a cover providing one of the plates of the parallel plate waveguide configuration and the central feed.

Referring now to FIG. 1A, one of the two parallel plates producing the radial waveguide of the device, namely 12, illustrated in FIG. 1B has been removed. The structure of FIG. 1A shown generally at 10 is built on the other of the two parallel plates, namely 11. A circumferential or outer perimeter rim 13 makes a flat bottom dish-like supporting structure. At the center of the plate 11, a transitional (matching) conical piece 19 is electrically fixed to 11. This conical transition is essentially coaxial with rim 13 and also the inner rim 14 which provides inward support and electrical continuity for each of the loops the top legs of which are typically 17 and 18. Associated with 17 and 18 are branch ports 15 and 16 respectively, the center conductors of these two coaxial ports 15 and 16 being connected to the outward edges of 17 and 18 respectively. The configurations of the plural loops illustrated in FIG. 1A, the wedge-shaped quarter wavelengths of which are illustrated 17 and 18 for two of these loops will be described in more detail in connection with FIGS. 2 and 3.

This also applies to the mode suppression resistors under the conductive plates shown at 29. Referring now to FIG. 2, the central feed side of the radial waveguide, i.e., comprising plate 12 is assumed to be in place. That is, subassembly of FIG. 1B is assumed to be placed over that of FIG. 1A, the subsequent figures presented herewith reflecting that situation. Referring now to FIG. 2, a section as indicated on FIG. 1A is taken through the loop which includes the wedge-shaped leg 18. As previously indicated, the internal ridge 14 forms a part of this loop as does the piece 26 placed against plate 11 and of the same shape basically as 18. The loop leg 18 will be seen to be connected to the center conductor of the coax branch port 16 at 28.

At this point it is also helpful to refer to FIG. 3 in order that this connection might be more fully appreciated. Here it will be seen that for coaxial branch ports 15 and 16 clearance holes 25 and 27 respectively are bored through the outer rim 13 so that the inner conductors of 15 and 16 pass coaxially therethrough in essentially the same coaxial (impedance) relationship as applied where 15 and 16 pass through 13.

From FIGS. 2 and 3 the placement of resistive pads 31 and 30 with bridging conductive member 29 will be evident. This symmetrical arrangement provides suppression of higher order modes which would produce currents orthogonal with respect to the indicated current directions on loop leg 17 and 18 as indicated on FIG. 3. Resistive patches 31 and 30 may be of carbon as well known in this art, however, for higher power levels of operation they may be of other materials such as nichrome deposited on beryllium oxide. The conductive plate 29 would ordinarily be of the same material as the loop legs 17 and 18, i.e., copper for example, suitably plated for environmental reasons.

In FIG. 2, the conductive liner 26 may have its function provided by the conductive plate 11 and thereby not be required if the impedance relationships in any particular design are satisfactory.

In connection with impedance relationships, it is useful to note that each loop is normally on the order of a quarter wavelength measured radially and acts as a balun for converting the cominant E-type mode energy between the inward loop perimeter (i.e., about 14 as illustrated in FIGS. 1A, 2 and 3) and the central feed at the center of FIG. 1A. It can also be shown, that the configuration of the balun loop in each case produces a 4 to 1 impedance transformation. That is, assuming the normal 50 ohm impedance for the coaxial branch ports such as 15 and 16, the characteristic impedance within the radial parallel plate waveguide structure from the central feed outward is on the order of 200 ohms. Obviously, other branch port impedances are possible, with corresponding parallel plate waveguide impedance values, the entire matter of specific impedances and corresponding dimensioning being subject to specific designs within the skill of this art. Accordingly, since the width of each of the wedge-shaped loop legs such as 17 and 18 and their spacing from plate 11 are factors affecting the impedance specifically, the constraints facing the designer must first be evaluated. That is to say, if, for example, the branch port impedance is fixed then the loop design must be such as to accommodate that impedance. Depending upon the actual number of branch ports about the circumference of the device, the diameter will ultimately be determined, since the impedance criteria are not well served by simply dividing a given diameter for the device into end segments without regard to the resulting impedance relationships.

It can be shown that the mode suppression resistors, i.e., resistive patches 30 and 31 in series will have a value on the order of twice the individual branch port impedances. Thus, for a 50 ohm branch port impedance (at 15 or 16, for example) 30 and 31 should be each 50 ohms since they are effectively in series through the bridging plate 29 to provide a 100 ohm value between loop legs 17 and 18.

Those of skill in this art will realize that the mode suppression resistor can be placed entirely on one or the other of the adjacent loop legs and electrically connected to the other by an appropriate bridging plate, however, the configuration contemplated in FIG. 3 has a greater heat sink capacity and therefore is more adaptable to higher power operations.

Referring now to FIG. 4, it is again assumed that the cover plate 12 of FIG. 1B is in place over the configuration of FIG. 1A and a section is taken as indicated. The conical transitions 19 of FIG. 1A will be seen to be approximately 45° from its centerline.

The core surface 19 provides a smooth transition between the parallel plate waveguide structure and the central feed, to substantially eliminate any inductive discontinuity. As a design objective, the ratio $^{w}/h$ (see FIG. 4) is selected so that the real impedance component (resistance) of the coaxial line formed by 21 and **21(*a*) is the same as the radial waveguide line formed between plates 11 and 12 at the radius $^{w}/2$ measured from the centerline of 21. The cone 19 has a hollow wall 23 surrounding the space 20 as indicated in FIG. 4, similarly the central feed coaxial center conductor 21 is preferably hollow. Although the cone and center conductor 21 could be of solid conductive material, there would appear to be no advantage to justify the additional weight. The concentric tubular outer conductor 21*a* will be seen to be that of FIG. 1B. In FIG. 1B the central port 33 may require impedance matching or transition if the coaxial characteristic impedance provided by the configuration of 21 and 21*a* is other than the standard connector at port 33 illustrated in FIG. 1B. Such a transition could of course be provided within the enclosure provided by 21*a*** in a manner well known to those of skill in the art.

The physical representation in FIG. 1A is consistent with a 20 branch port device, however, over 100 branch ports were provided in one implementation according to the invention. It will be noted that the loops all intercept the field between the parallel plates 11 and 12 (vectors identified in FIG. 4) about a concentric circular line defined by the internal ridge 14. The symmetry of the device is an important consideration in preventing the exertation of higher order (undesirable) modes. Of course, in a practical design it is not possible to entirely suppress such higher order modes merely by symmetry because the structure cannot practically be perfectly symmetrical and the loops cannot be identical. As hereinbefore indicated the radially disposed resistors between adjacent legs (such as 17 and 18) of the loops are provided for the suppression of any such undesired modes as are excited.

In a 20 branch version for 1215 to 1400 MHz operation, such as pictured in drawings, the loops were spaced 1.25 inches between radial centerlines measured circumferentially about the aforementioned concentric circular line defined by the internal ridge 14. With all branch ports uniformly excited, the impedance matching is excellent. With only a single branch port excited the match was very good and subject to some further improvement by shortening the radial, quarter-wave loop dimension slightly. Isolation between adjacent ports of 13 dB was considered acceptable, especially for the application in which the branch ports are driven from individual solid-state RF generators to form a high power output from the central port 33. Adjacent port isolation is subject to improvement by optimization of the higher order mode absorbers. Measured overall insertion loss was on the order of 0.20 dB. The device is, of course, reciprocal and is inherently broad band. Power handling capability exceeds 100 KW peak and 7 KW average.

Based on an understanding of the invention from the foregoing, it will be evident to those of skill in this art that various modifications are possible within the inventive concept. For one example, the central and branch port feeds could be adapted from other than coaxial feed means.

It is not intended that the invention be considered limited by the drawings presented and this description, these being intended to be typical and illustrative only.

What is claimed is:

1. A radio-frequency power divider and combiner comprising:

a fixed structure including first and second parallel plates;

branching means comprising a plurality of conductive loops symmetrically spaced, extending radially outward from a first circle within a central area between said plates, and outwardly abutting a second circle;

a feed electrically symmetrical in planes parallel to said first and second plates for coupling to the volume within said central area between said first and second plates to produce a relatively uniform dominant E mode therein, said feed connecting through one of said plates substantially at the center of said first circle;

means comprising a branch port connected to each of said loops at the open end thereof within and adjacent said second circle, said loops otherwise providing closed current paths in planes generally normal to said plates;

a common port connected to said feed;

and spurious waveguide mode suppression means comprising a plurality of resistors, one of said resistors being between each adjacent pair of said loops inside and adjacent to said second circle.

2. Apparatus according to claim 1 in which said symmetrical feed is a coaxial feed, the outer conductor of which is connected to said first parallel plate and the center conductor of which connects through said volume within said plates to said second plate.

3. Apparatus according to claim 2 in which said coaxial feed center conductor is flared into a diverging conical shape as it extends to said second plate to provide an impedance matching transition.

4. Apparatus according to claim 1 in which said loops are each of a total electrical wavelength approximating one-half wavelength, one leg of each of said loops being conductively integral with a portion of said first plate and the other leg of each of said loops being in the form of a conductive strip of wedge shape increasing in width approaching said second circle in a plane parallel to said first and second plates and spaced approximately midway between said first and second plates.

5. Apparatus according to claim 1 in which each of said branch ports includes a coaxial connector.

6. Apparatus according to claim 5 in which said loops of said branching means are designed to provide substantially a four-to-one impedance transformation to match said nominal coaxial impedance of said branch port connectors to that extant at the radially inward extremities of said branching means.

* * * * *